US005417350A

United States Patent [19]

Koo

[11] Patent Number: 5,417,350

[45] Date of Patent: May 23, 1995

[54] FLIP TOP CLOSURE

[75] Inventor: James Y. C. Koo, Strasburg, Pa.

[73] Assignee: Kerr Group, Inc., Lancaster, Pa.

[21] Appl. No.: 305,984

[22] Filed: Sep. 19, 1984

Related U.S. Application Data

[63] Continuation-in-part of Ser. No. 49,914, Apr. 20, 1993, Pat. No. 5,348,201.

[51] Int. Cl.[6] ..... B65D 51/04

[52] U.S. Cl. ..... 222/556; 215/235; 220/338; 222/546

[58] Field of Search ..... 222/546, 556; 220/338; 215/235, 237

[56] References Cited

U.S. PATENT DOCUMENTS

| | | | |
|---|---|---|---|
| 3,045,860 | 7/1962 | Harvey | 220/338 |
| 4,209,114 | 6/1980 | Wilson et al. | 222/556 |
| 4,632,266 | 12/1986 | Osswald | 220/338 |
| 4,666,068 | 5/1987 | Bush | 222/556 |
| 4,682,702 | 7/1987 | Gach | 215/235 |
| 4,790,442 | 12/1988 | Gach | 215/237 |
| 4,826,026 | 5/1989 | Gach et al. | 215/237 |
| 4,993,606 | 2/1991 | Bolen, Jr. et al. | 222/546 |
| 5,065,911 | 11/1991 | Rohr et al. | 215/235 |
| 5,251,793 | 10/1993 | Bolen, Jr. et al. | 222/556 |
| 5,348,201 | 9/1994 | Koo | 222/556 |

*Primary Examiner*—Andres Kashnikow

*Assistant Examiner*—Christopher G. Trainor

*Attorney, Agent, or Firm*—Kenyon & Kenyon

[57] ABSTRACT

A closure including an improved hinge includes a cap member selectively coupleable to a container to cover an opening in the container. The cap member includes a first substantially planar member, a depending skirt and an aperture formed through the first substantially planar member. A solid member integrally formed with the cap member projects out of the first substantially planar member. The solid member includes an upper surface and two opposed side surfaces, with each of the opposed side surfaces having an indentation formed therein. The closure further includes a flip top having a plug wherein, when the flip top is in a closed position, the plug seals the aperture formed in the first substantially planar member and the flip top covers substantially all of the first planar member, wherein the flip top includes a cut-out area to accommodate the solid member so that, when the flip top is in the closed position, the flip top and the upper surface of the solid member form a substantially continuous surface. The flip top also includes two projections on opposed sides of the cut-out area, each projection being received in a corresponding indentation in the solid member to couple the flip top to the solid member so that it may be rotated between the closed position and an open position in which the plug is removed from the aperture.

10 Claims, 9 Drawing Sheets

FLIP TOP CLOSURE

This is a continuation-in-part application of application Ser. No. 08/049,914 filed 20 Apr. 1993, now U.S. Pat. No. 5,348,201.

FIELD OF THE INVENTION

The present invention relates to child resistant closures and particularly to an improved flip top closure.

BACKGROUND OF THE INVENTION

Hinged closures, also referred to as "flip top" closures incorporate a base and a lid. The base is adapted to engage a closure, and incorporates a top surface having an opening. The lid is attached to the base by a connection such as a hinge so that the lid is movable, relative to the base, between closed and open positions. In the closed position, the lid overlies the top surface of the base and occludes the opening, whereas in the open position the lid is remote from the opening. When the base is secured to the mouth of a container, the lid controls access to the contents of the container. The base, lid and hinge may be molded as elements of a single, integral piece of plastic material.

Various attempts have been made to provide child resistant flip top closures having features which impede opening of the lid by a child but which permit opening of the lid by an adult. Such child-resistant features are useful where the closure is employed on a container holding a toxic or otherwise hazardous material.

British patent application No. 2 158 048 A discloses a flip top cap having a ring movably mounted to the base. In the normal position of the ring, the ring protrudes upwardly from the base and surrounds the lid when the lid is in the closed position. Thus, the periphery of the lid is inaccessible, and a child cannot engage the lid to move it from the closed position to the open position. An adult can move the ring downwardly relative to the base so as to gain access to the lid, but a child normally cannot accomplish the required twisting and sliding motion. The closure shown in U.S. Pat. No. 3,584,760, utilizes a guard ring rotatable relative to the base with a separate spring for biasing the guard ring. These features add cost and complexity to such a device, and, significantly, suffer from the disadvantage that the covering member must be physically manipulated back from the uncovered to the covered position. In other words, without such manipulation after use of the closure, the container contents remain accessible to children.

Others have attempted to make a satisfactory child resistant flip top closure having all of its elements molded in a single piece. As disclosed in U.S. Pat. Nos. 3,556,331 and 3,604,585, the lid may have an elongated, rectangular shape, whereas the base may have a narrow slot in its top surface. When the lid is in its closed position, it is recessed within the slot in the top surface of the base. The parts are dimensioned so as to provide only a very narrow opening at the end of the lid remote from the hinge so that the lid can be opened only by an adult capable of engaging a tool or fingernail within this narrow opening. U.S. Pat. No. 4,047,495 describes a child resistant closure wherein the base is provided with an upstanding rim or wall around its top surface, such that the lid is recessed within this rim when in the closed position. The base is also provided with a projection adjacent the middle of the top surface so that the underside of the lid bears on the projection. The lid can be opened by forcing its rearward portion, adjacent the hinge, downwardly, towards the base. The projection on the base acts as a fulcrum, causing the forward portion of the lid to lift upwardly and hence to project above the rim on the base. In this condition the forward portion of the lid can be engaged and pulled upwardly, away from the base so as to swing the lid to its open position. U.S. Pat. No. 4,371,095 utilizes a similar arrangement. U.S. Pat. No. 4,533,058 employs an elongated, strap-like lid received in an elongated slot extending across the entire top surface of the base from the rear or hinge side to the front side. The base is provided with a cam surface such that when the distal portion of the strap-like lid, remote from the hinge, is forced downwardly, the tip of the lid is forced outwardly at the front of the base. The outwardly projecting tip can be engaged and pulled upwardly.

U.S. Pat. No. 4,444,326 discloses a flip top closure having a base integral with the container body itself and incorporating a peripheral wall on the base which can be forced inwardly at one location so as to expose the underside of the lid for manual engagement. U.S. Pat. No. 4,209,100 shows a further child resistant closure having a lid which is recessed in the top surface of the base when the lid is in the closed position. The base has an upstanding peripheral wall abutting the forward portion of the lid, remote from the hinge. This peripheral wall is arranged so that it can be forced inwardly, towards the lid. The lid and peripheral wall are provided with cam surfaces so that inward motion of the peripheral wall will move the lid upwardly, away from its closed position to a partially open position. In this partially open position, the lid protrudes above the top surface of the base and hence is accessible for manual engagement by the user.

A further child resistant closure is disclosed in U.S. Pat. No. 3,826,394. The closure of the U.S. Pat. No. 3,826,394 includes a lid having a projection at the distal extremity of the lid, remote from the hinge. The projection extends forwardly adjacent the forward edge of the base when the lid is in the closed position. A pair of guard members mounted on the forward edge of the base define a vertically extensive slot. The projection on the distal end of the lid is disposed in the slot when the cap is in the closed position. In some embodiments of the U.S. Pat. No. 3,826,394 closure, such as those shown in FIGS. 4–6 and 7–9 thereof, a flat, plate-like tab extends between the guard members or projects upwardly in the slot between the guard members. The tab confronts the distal extremity of the projection on the lid. To open the lid, the tab is flexed forwardly and hence away from the lid and a finger or fingernail is inserted under the projection.

Each of the aforementioned closures leaves something to be desired with respect to resistance to opening by a child, ease of opening by an adult, manufacturing cost, appearance and other important factors. Despite the extensive efforts made by the art heretofore towards development of a truly satisfactory child resistant flip top closure, there remains a need for still further improvements.

In addition, the hinges employed in such closures also leave something to be desired. Specifically, there are a number of problems with the "living hinges" employed in many such closures. Specifically, most living hinges include at least one bent plastic spring member which operates so that, depending upon the position of the flip top, the flip top is biased into either the closed position or the open position. That is, while the flip top is closed, the spring member is biased to maintain the flip top in the closed position. However, as the flip top is moved from the closed position toward the open position, an intermediate point is passed at which the bias of the spring member reverses so that the flip top is now urged into the fully open position. Conversely, as the flip top is moved from the fully open position toward the closed position, a point is passed at which the spring member suddenly urges the cap into the fully closed position. This may result in splashing of liquid from underneath the flip top which may soil or damage items on which any liquid is spilled. In addition, the living hinges usually project beyond the sides of the closure interfering with the operation of automatic capping machines. This also hampers the application of other items, such as tamper evident sleeves, after capping.

U.S. Pat. No. 4,666,068 to Bush shows a two piece closure which includes a hinge having two posts projecting from a cap which may be screwed onto a container. Each of the posts is received in a corresponding slot in a lid. Each of the posts includes a small projection each of which is received in a corresponding depression within a respective slot. The lid rotates about the projections to close a dispensing orifice in the cap. However, inserting the twin projections of the Bush closure into the slots of the lid is difficult and adds to the time and cost associated with the assembly of the closures. In addition, the thin posts of the Bush closure may weaken and break during assembly or use.

Thus, there is a need for a hinge for closures which allows for a smooth continuous surface across the entire circumference and top surface of the closure and which is sturdy and easy to assemble.

ADVANTAGES AND SUMMARY OF THE INVENTION

Accordingly, it is an advantage of the present invention to provide a flip top closure device for a dispensing opening of a container, comprising a first body member with a flip top adapted to be mounted on the container, and a second body member mounted on the first body member and having a part which is usually in overlapping relation with the flip top to prevent opening thereof, which part is displaceable from said overlapping relation to expose the edge of the flip top for opening thereof and which part is automatically returned to the overlapping position without need for external physical manipulation.

It is another advantage of the present invention to provide a child-resistant flip top closure for sealing an open-topped container having an external screw thread formed on the neck of the container, the closure comprising an outer cap having a first top end wall and a first skirt depending from the outer edge thereof; an inner cap having a second top end wall, a flip top and a dispensing aperture formed through said second top end wall, and an internally threaded second skirt depending from the outer edge thereof for engagement with the external screw thread on the container, the outer cap overlying the inner cap and being concentric therewith; the first top end wall of the outer cap having a second aperture large enough to receive the flip top; and a plurality of spring tabs integrally attached to and extending radially upwardly from said second top end wall; such that when the outer cap and inner cap are assembled, the first skirt of the first top wall being in overlapping relation with said flip top and said spring tabs contacting the underside of the first top wall of the outer cap so as to exert upward axial pressure on said first top wall so as to maintain the first skirt's overlapping relation with said flip top.

A further improved closure according to the present invention includes a cap member selectively coupleable to a container to cover an opening in the container. The cap member includes a first substantially planar member and a depending skirt with an aperture formed through the first substantially planar member. A solid member integrally formed with the cap member projects out of the first substantially planar member and includes an upper surface and two opposed side surfaces. Each of the opposed side surfaces of the solid member includes an indentation. The closure further includes a flip top having a plug which, when the flip top is in a closed position, seals the aperture in the first substantially planar member and covers substantially all of an upper surface of the first planar member. The flip top includes a cut-out area to accommodate the solid member so that, when the flip top is in the closed position, the flip top and the upper surface of the solid member form a substantially continuous surface. The flip top also includes two projections on opposed sides of the cut-out area, each projection being received in a corresponding indentation in the solid member to couple the flip top to the solid member so that it may be rotated between the closed position and an open position in which the plug is removed from the aperture.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DESCRIPTION OF THE PREFERRED EMBODIMENTS

Figure 1:
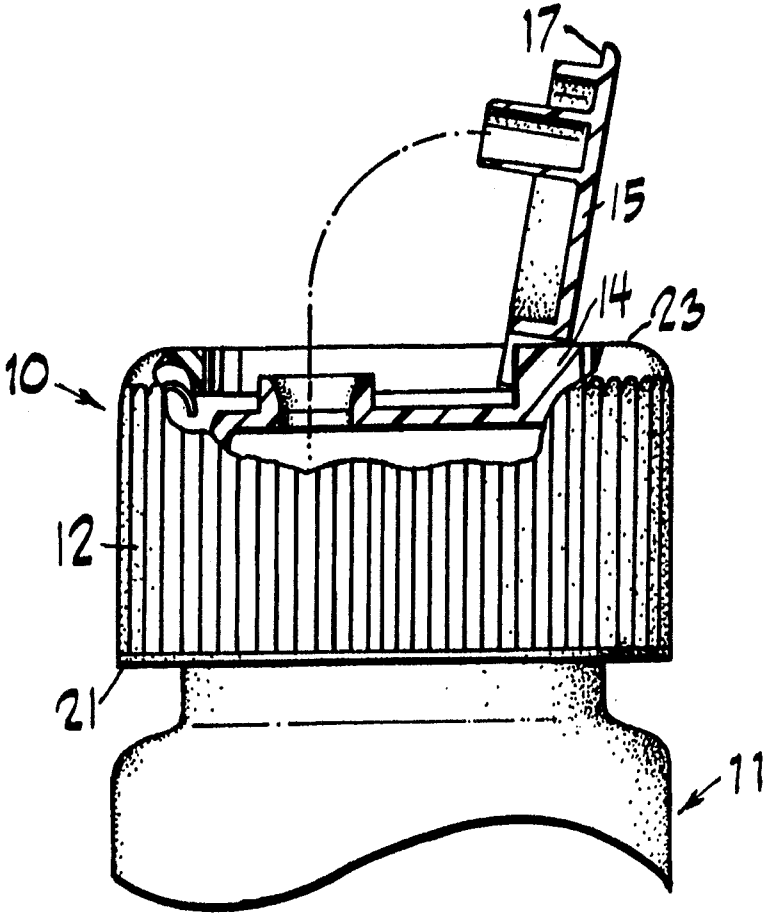
FIG. 1 is a side elevational view, partly in longitudinal section, of a first embodiment of a flip top closure device according to the invention, with a cap protection element in the normal position and an inner cap flap element in a raised position.
Figure 3:
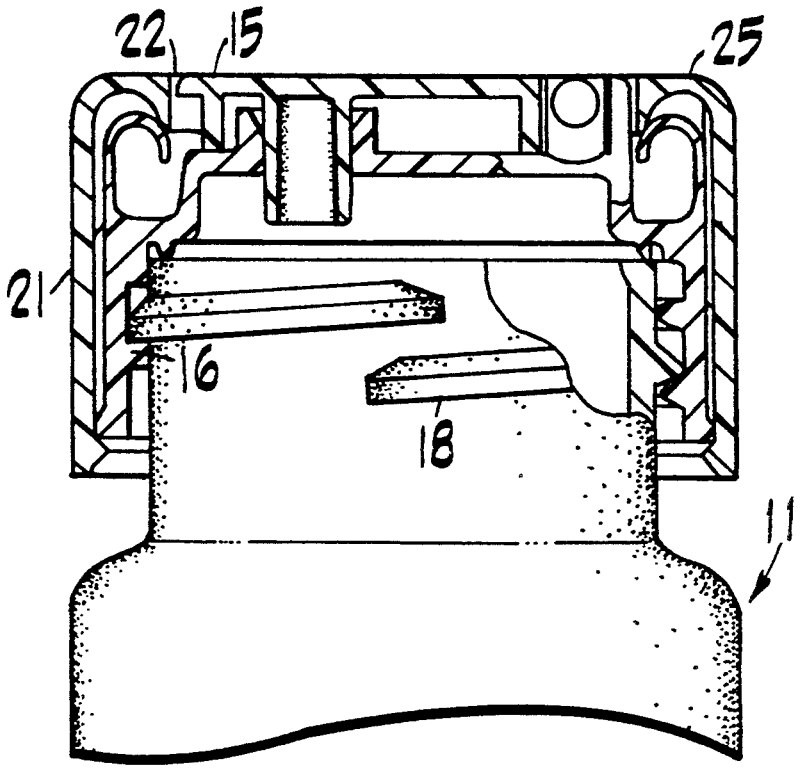
FIG. 3 is a side elevational view of the flip top closure of FIG. 1, partly in longitudinal section with the cap element in the normal position.
Figure 4:
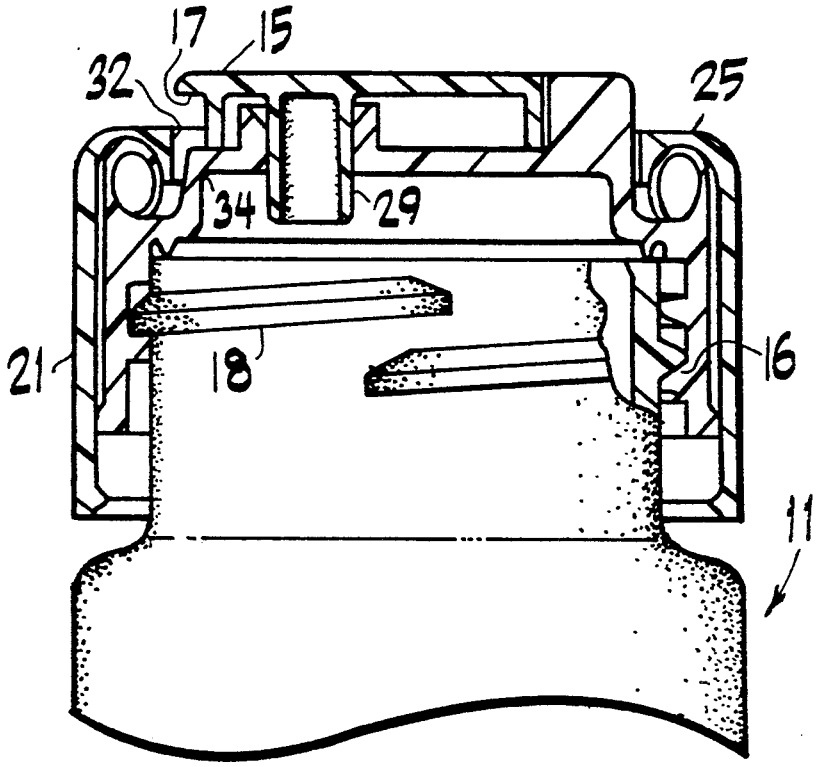
FIG. 4 is a side elevational view of the flip top closure of FIG. 1, partly in longitudinal section with the cap element in the depressed release position.
Figure 5:
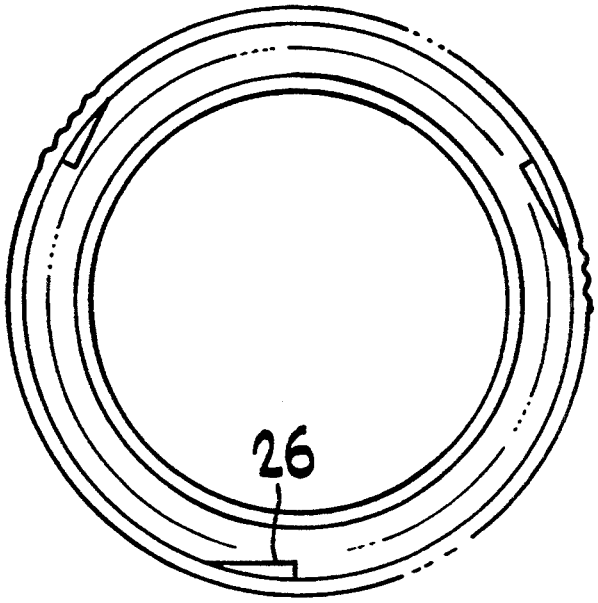
FIG. 5 is a plan view of the flip top closure of FIG. 1 looking at the underside of the cap element and illustrating ratchet elements.

Turning to the drawings (FIGS. 1–9, and particularly FIGS. 1, 3 and 4) there is shown a child-resistant, two-piece closure, generally indicated by 10, fastened to a container indicated generally by 11. The closure 10 includes an outer cap 12 having an end wall 23 and a skirt 21 depending therefrom overlying an inner cap 14 having a flip top 15 and a dispensing aperture 19 formed through an upper wall 30.

The inner and outer caps are concentrically aligned and are preferably formed in single pieces by molding a relatively hard resilient plastic such as polypropylene. To fasten the closure 10 to the container 11, a generally cylindrically shaped skirt 13 of the inner cap 14 is formed with a container fastening means such as a spiral screw thread 16 which cooperates with a corresponding shaped screw thread 18 on the container 11.

The outer cap member 12 is formed with a circular top panel 25 integrally molded with the depending skirt portion 21 and having a through aperture 22 large enough to receive the flip top 15. Molded on the inner side 24 of depending skirt 21 are a plurality of ramp members 26 (see FIG. 5) which cooperate in a ratchet relationship with corresponding members 28 located on the outside 30 of the inner cap's skirt member 13 (see FIG. 6). Also depending from the top panel 25 about the circumference of aperture 22 is a second skirt member 32, whose function is described in detail below.

Figure 11:
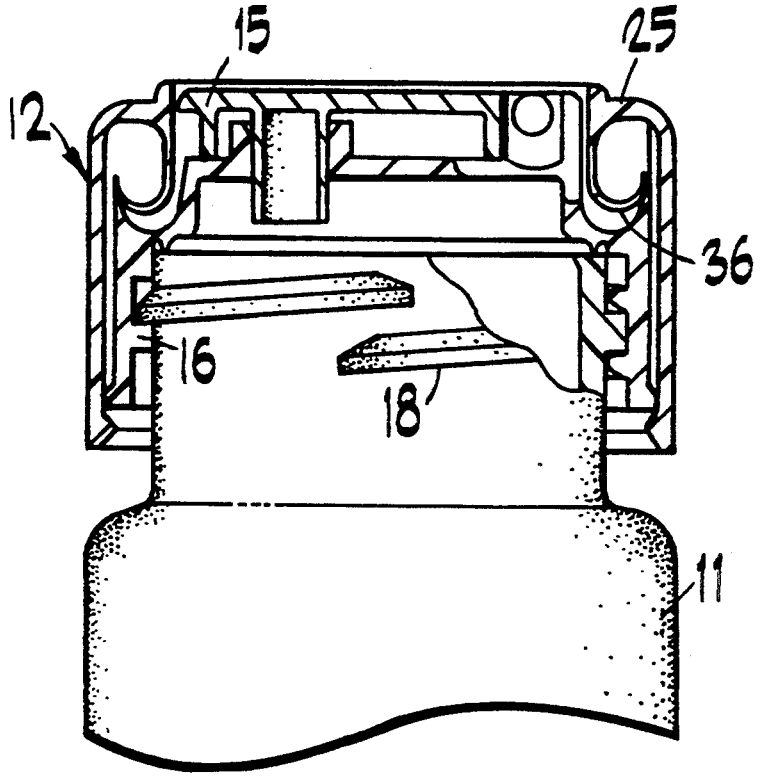
FIG. 11 is a side elevational view, partly in longitudinal section, of a third embodiment of a flip top closure device of the invention.

The depending skirt 13 of the inner cap member 14 has axially extending radial ramps 28, which, as described below, function in ratchet engagement with corresponding ramp members 26 on the inner side of outer cap depending skirt 21. Extending radially upwardly from the edge of end wall 30 and skirt 13, along an axis parallel to that of the skirt, are at least three, and preferably four, spaced integrally molded spring tabs 36. As will be appreciated by those skilled in the art, the actual shape of the spring tabs is irrelevant, so long as they provide the desired restorative force (as described in further detail below). In addition, the spring tabs 36 may be located on the outer cap, as is depicted in FIG. 11. The number of spring tabs 36 effects the amount of force required to depress the outer cap member 12 for access to the flip top 15 (described in more detail below) and, significantly, returns the outer cap member to the child resistant position without need for external physical manipulation. In other words, return of the outer cap to overlapping relation with the inner cap is automatic.

Figure 2:
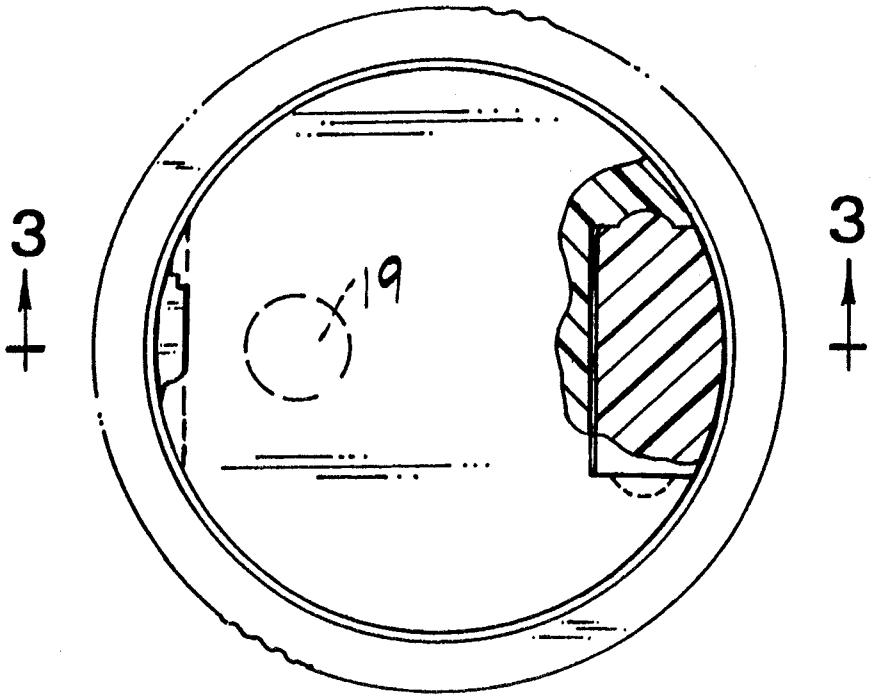
FIG. 2 is a top plan view of the flip top closure of FIG. 1 showing a partial section of the hinge element.

The end wall 30 of the inner cap member 14 mounts the flip top 15 by an integral connector or hinge 27. For reasons which will become obvious, the flip top 15 and hinge 27 element are mounted on a platform member 34 which is inset from the skirt 13 a distance which corresponds with the distance between skirt members 21 and 32 of the outer cap 12. The flip top 15 has a spigot 29 for plugging the dispensing aperture 19 in the usual closed position. Naturally, there is no limitation in the size of the aperture and associated spigot, their size depending on the intended contents of the container (e.g., liquid, lotion, powders, or tablets). The flip top 15 also has, opposite the hinge 27, a rebate providing a lip 33 by which the flip top can be pivoted upwardly (as viewed) about the hinge 27 from the FIG. 8 position to the FIG. 7 position. FIG. 2 is a top plan view of the inner cap member 14 showing a partial section of a preferred construction for the hinge 27 and a partial cut-away view of the undercut which forms the lip 33. As will be appreciated by those skilled in the art, multiple configurations may be used for the hinge; e.g., a ball and socket hinge.

Closure 10 is formed by assembling the outer cap member 12 and the inner cap member 14. To assemble the completed closure 10, a retention bead 42 of outer cap member 12 is forced over a corresponding retention bead 38 of inner cap member 14. The process of assembling the two cap members further causes the spring tabs 36 to contact the underside 32 of the outer cap's end wall and, by virtue of the arrangement and shape of skirts 21 and 32, bend into a U-shape. When the closure 10 is fully assembled, the bent spring tabs 36 exert upward axial pressure on the underside 40 of end wall, assuring that without externally applied downward axial pressure on the outer cap member, it will remain in the child resistant position.

In use, the closure device 10 is mounted on a container 11 by screw engagement of the threads 16 with threads 18 of the container 11. The closure device 10 is in the usual, closed, position shown in FIG. 3 with the entire peripheral edge of the flip top 15, including the hinge 27, overlapped by the skirt 21 of the outer cap member 14. In other words, in normal position the skirt 21 is in overlapping relation with the flip top 15 to prevent access to the lip 33 and opening thereof, which skirt 21 is displaceable from said overlapping relation to expose the lip 33 of the flip top 15 for opening thereof. The flip top 15 can therefor not be operated when the skirt 21 is in the normal position as it is not possible to apply upward pressure to the lip 33 to lift the flip top (thus rendering the closure child resistant).

If it is desired to dispense some contents from the container, the entire outer cap 12, including particularly the skirt member 21, is displaced axially downwardly by applying downward pressure on skirt member 21. The result is that skirt member 21 is removed from overlapping engagement with the edge of the flip top 15, thus exposing the lip 33 (See FIG. 4). Upward pressure on lip 33 then flips the flip top 15 to the FIG. 1 position so that the dispensing aperture 19 is unplugged. The closure is returned to the FIG. 3 configuration by returning the flip top 15 to plug the dispensing aperture 19. Concurrently, by virtue of upward axial pressure exerted by the spring tabs 36 (i.e., restorative force), skirt 21 overlaps the peripheral edge of the flip top 15 so that opening thereof is obviated. Molded on the inner side 24 of depending skirt 21 are a plurality of ramp members 26 (see FIG. 5) which cooperate in a ratchet relationship with corresponding members 28 located on the outside 30 of the inner cap's skirt member 13.

Figure 6:
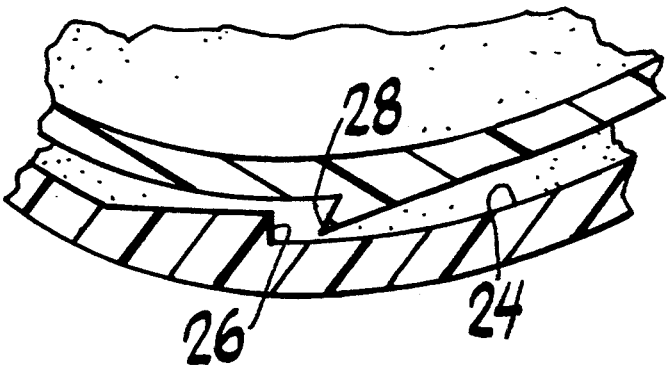
FIG. 6 is an exploded partial view of the cap element illustrating a ratchet mechanism for contact with an outer cap element.
Figure 7:
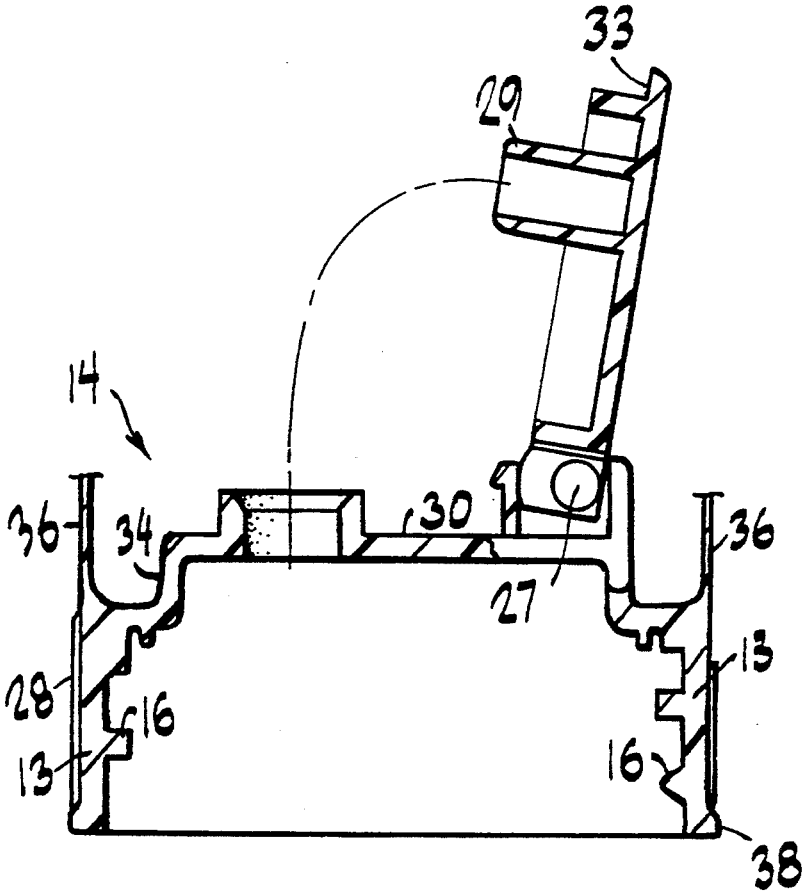
FIG. 7 is a side elevational view, partly in longitudinal section, of the inner cap element with the flap element in a raised position.
Figure 8:
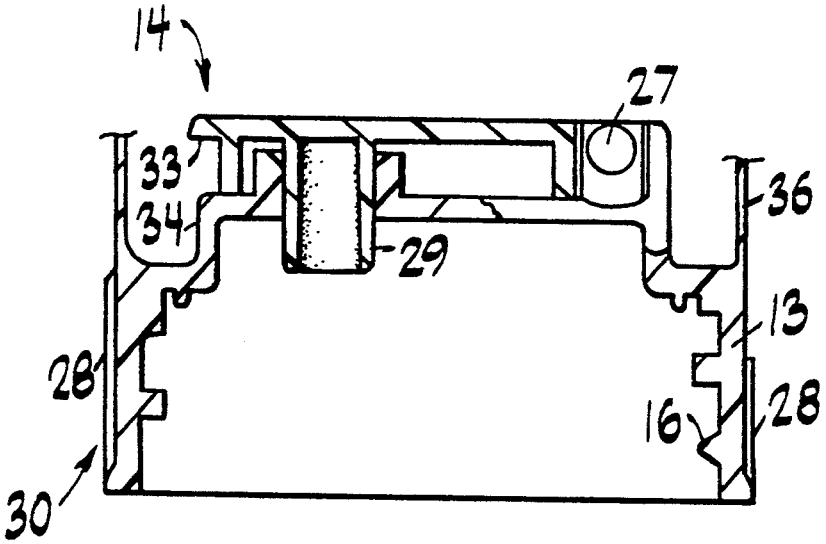
FIG. 8 is a side elevational view, partly in longitudinal section, of the inner cap element with the flap element in a lowered or closed position.
Figure 9:
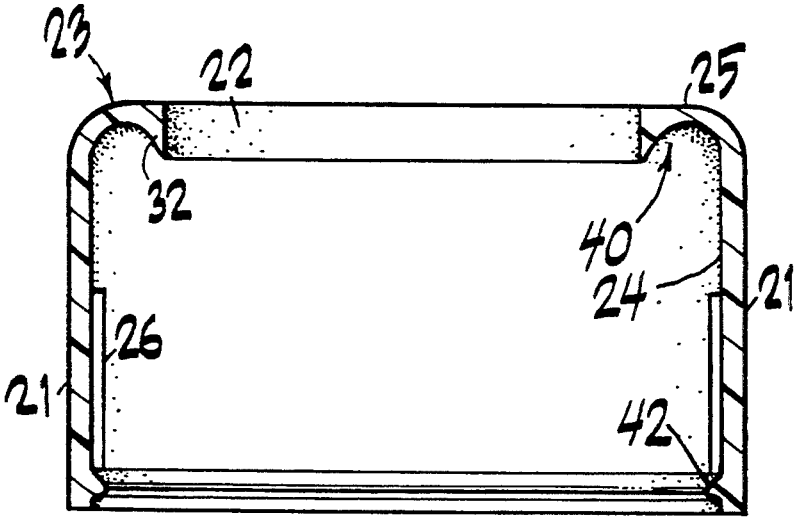
FIG. 9 is a side elevational view, partly in longitudinal section, of the outer cap element.

Turning now to FIG. 6, in order to install the closure on a container, movement of the outer cap member 12 in the clockwise direction causes engagement of ramp members 26 with corresponding ramp members 28, thereby causing the closure to torque on to the container. By contrast, once the closure has been applied to the container with sufficient torque, turning the outer cap member in the counterclockwise direction causes ramps 26 and 28 to ride over one another, thereby preventing the undesired removal of the closure from the container. As will be appreciated by those skilled in the art, there are many other construction methods available to prevent the undesired removal of the closure from the container.

Figure 10:
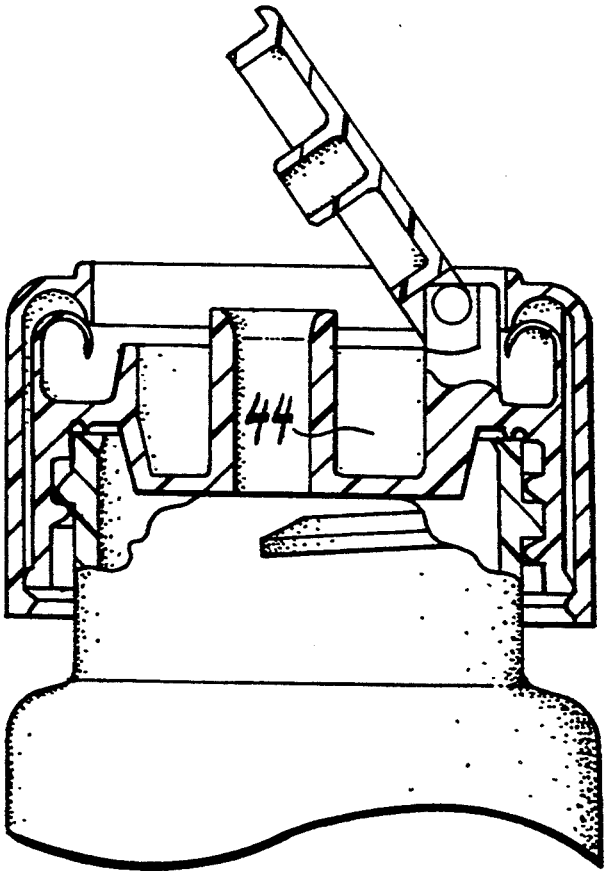
FIG. 10 is side elevational view, partly in longitudinal section, of a second embodiment of a flip top closure device according to the invention, with the cap protection element in the normal position and the inner cap flip top element in a raised position.

Turning to FIG. 10, there is illustrated a second preferred embodiment for use where the container is intended to accommodate a liquid. By way of background, the use of the closure configuration of the first embodiment may be problematic if the intended contents of the container are a liquid or, more likely for pharmaceuticals, a lotion. In such event, it is possible that the liquid/lotion will pool around the aperture 19, thereby inhibiting closing of the flip top 15 by interfering with the operation of the hinge 27.

This potential problem is obviated by the construction of a closure in the form of the second embodiment where a recessed well 44 is provided to accommodate spillage. In practice, then, any liquid/lotion which remains after dispensing will collect in the recessed well 44, rather than around the upper wall 30 of inner cap 14, thereby obviating any interference with the flip top mechanism.

Figure 12:
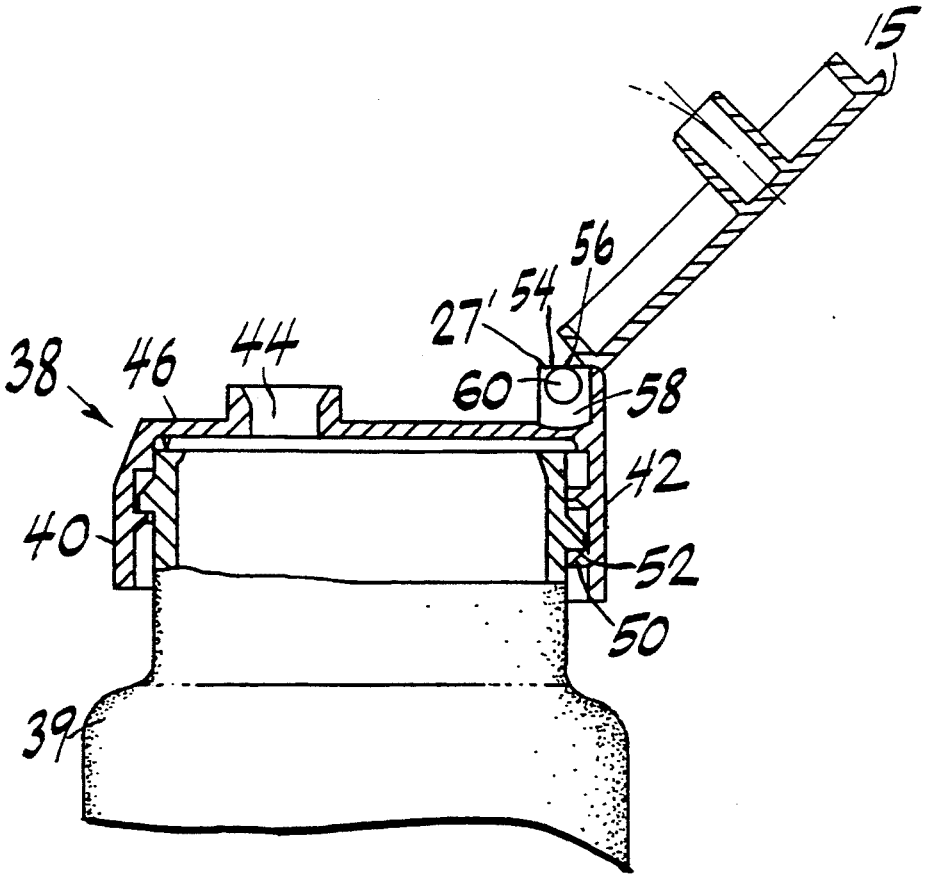
FIG. 12 shows a cross-sectional side view of a closure including an improved hinge according to a fourth embodiment of the present invention wherein the flip top is in an open position.

In addition, any of the above described embodiments of the present invention may include an improved hinge 27' as shown in FIGS. 12–15. Those skilled in the art will recognize that, although the closure 38 shown in FIG. 12 is not a child resistent closure as described in regard to the previous embodiments, the improved hinge 27' according to this embodiment of the invention may also be employed in a child resistent closure according to any of the three embodiments described above.

Figure 13:
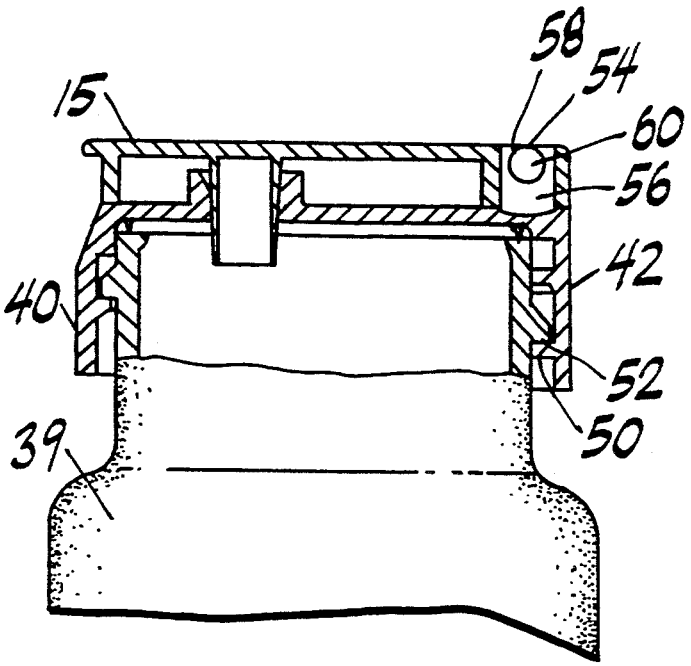
FIG. 13 shows a cross-sectional side view of a closure including an improved hinge according to the fourth embodiment of the present invention wherein the flip top is in a closed position.

The improved hinge 27, couples the flip top 15 to the lower cap 40 so that the flip top 15 may swing between an open position as shown in FIG. 12 and a closed position as shown in FIG. 13. As with the embodiments described above, the lower cap 40 includes an annular depending skirt 42, a dispensing aperture 44 formed through an upper wall 46. To fasten the closure 38 to the container 39, the skirt 42 of the lower cap 40 is formed with a container fastening means such as a spiral screw thread 50 which cooperates with a corresponding shaped screw thread 52 on the container 39.

Figure 14:
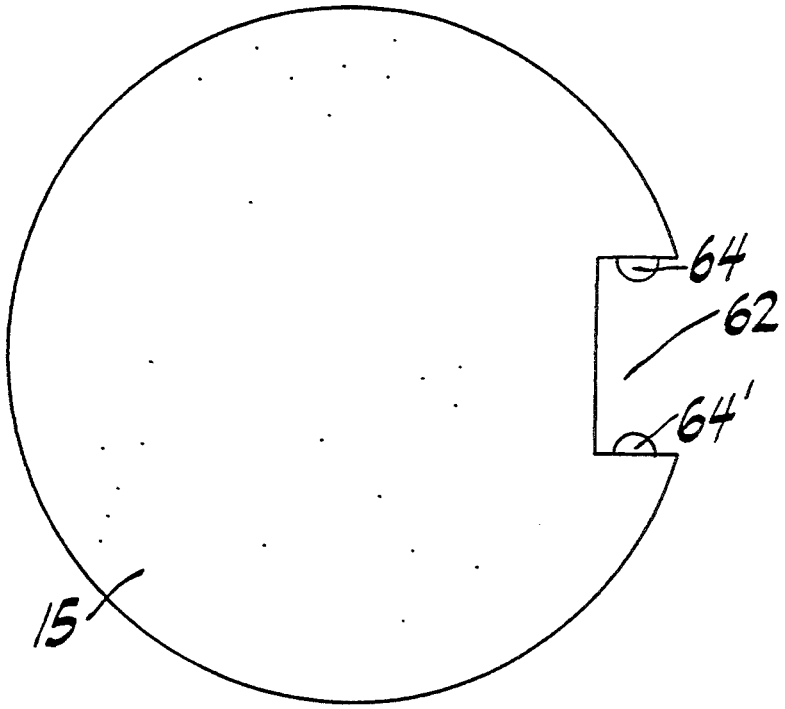
FIG. 14 shows a top view of a flip top of a closure including an improved hinge according to the fourth embodiment of the invention.
Figure 15:
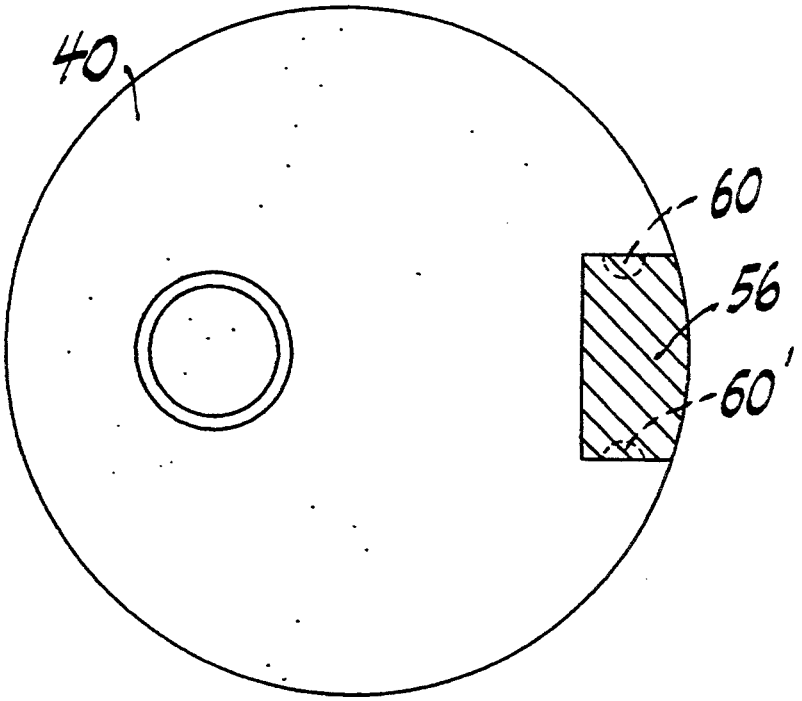
FIG. 15 shows a top view of a lower cap member including an improved hinge according to the fourth embodiment of the invention.

The improved hinge 27' is formed between a single substantially rectangular projection 56 raised from an edge of the lower cap 40 and the flip top 15. The rectangular projection 56 is substantially rectangular except that an outer edge of this surface is formed along an arc corresponding to the contour of the lower cap 40. The rectangular projection 56 includes a flat upper surface 54 and two opposed substantially vertical side surfaces 58 and 58' which include substantially hemispherical indentations 60 and 60', respectively. The flip top 15 includes a cut-out area 62 which corresponds in size and shape to the upper surface 54 of the rectangular projection 56. The flip top 15 includes two substantially hemispherical projections 64 and 64' on either side of the cut-out area 62 which are sized to be press fit into the recesses 60 and 60', respectively, so that the flip top 15 may rotate about the projections 64 and 64'. As seen in FIGS. 12–14, the elevation of the projections 64 and 64' and the elevation of the indentations 60 and 60' are slightly below the elevation of the upper surface 56 and the upper surface of the flip top 15. Thus, when the flip top 15 is in the closed position, the upper surface of the flip top 15 and the upper surface 56 cooperate to form a single substantially flat upper surface of the closure 38. The cut-out area 62 may be formed so that the projections 64 and 64' are biased inward into the indentations 60 and 60'. This biasing force maintains the flip top 15 at any position in which it may be left between the fully closed and the fully opened positions.

Figure 16:
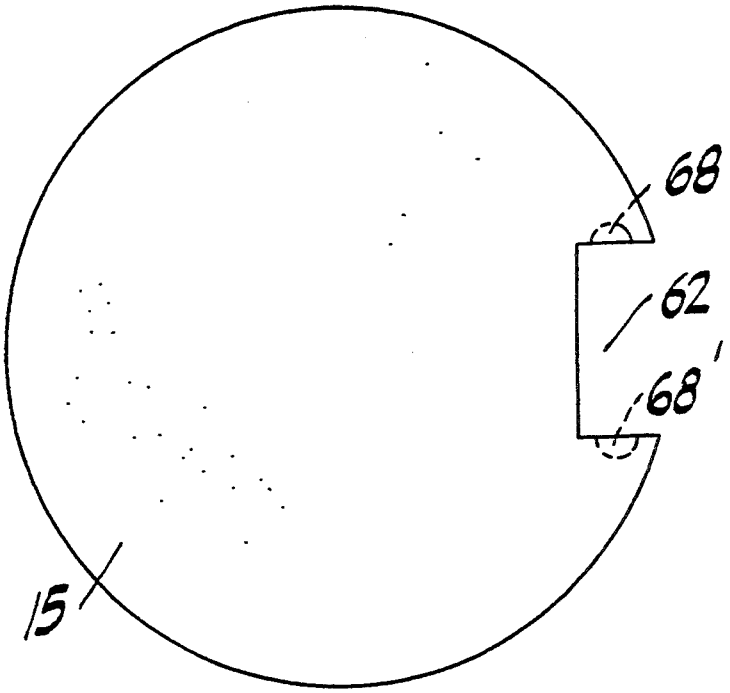
FIG. 16 shows a top view of a flip top of a closure including an improved hinge according to a fifth embodiment of the invention.
Figure 17:
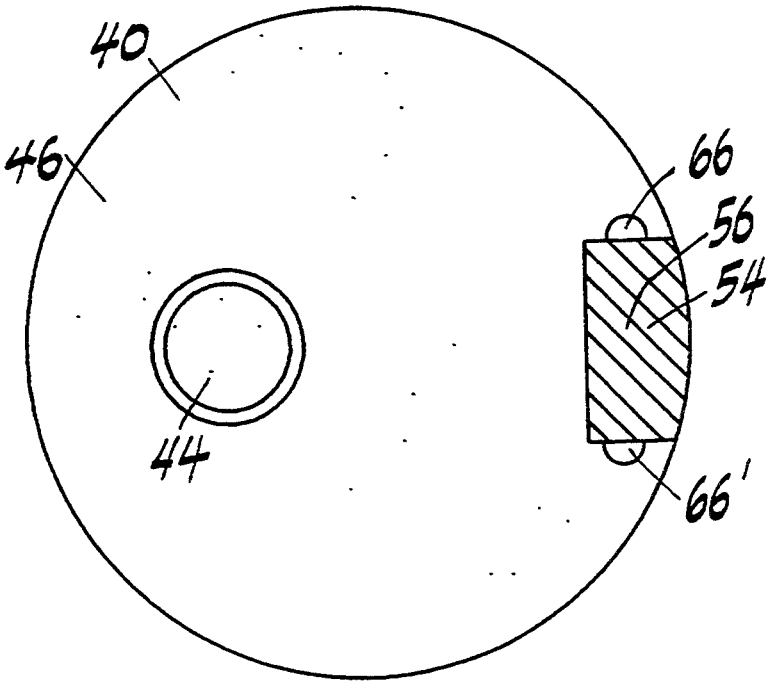
FIG. 17 shows a top view of a lower cap member including an improved hinge according to the fifth embodiment of the invention.

The closure of FIGS. 16 and 17 is similar to the closure of FIGS. 12–15 except that the rectangular projection 56 includes two substantially hemispherical projections 66 and 66' while the flip top 15 includes a pair of corresponding substantially hemispherical indentations 68 and 68'. In the closure according to this embodiment, the cut-out area 62 may be formed so that the indentations 68 and 68' are biased inward to receive the projections 66 and 66'. This biasing force maintains the flip top 15 according to this embodiment of the invention at any position in which it may be left between the fully closed and the fully opened positions.

Those skilled in the art will recognize that closures employing the improved hinge 27' need not be round. Rather, any shaped closure may accommodate such a hinge so long as the shape of the projection 56 corresponds to the shape of the cut-out area 62. In addition, it may be desired to maintain the contour of the outer edge of the projection 56 corresponding to the outer edge of the lower cap 40 so that an entire outer surface of the closure remains smooth and continuous.

Thus, it can be seen that an improved flip top closure and an improved hinge for a flip top closure are provided by the present invention. While preferred embodiments of the invention have been shown and described herein, there is no intent to limit the invention by this description. On the contrary, the invention is intended to cover all modifications and alternatives falling within the scope of the accompanying claims.

What I claim is:

1. A closure including an improved hinge wherein, when in an operative position, the closure selectively seals an opening in a container, the closure comprising:

a cap member selectively coupleable to the container to cover the opening in the container, wherein the cap member includes a first substantially planar member and a depending skirt wherein, when the closure is in an operative position, a first side of the first substantially planar member faces the interior of the container and a second side faces away from the container, wherein an aperture is formed through the first substantially planar member;

a solid member integrally formed with the cap member, wherein the solid member projects out of the first substantially planar member in a direction away from the second side, wherein the solid member includes an upper surface and two opposed side surfaces, each of the opposed side surfaces including an indentation; and a flip top including a plug wherein, when the flip top is in a closed position, the plug seals the aperture formed in the first substantially planar member and the flip top covers substantially all of the second side of the first planar member and wherein the flip top includes a cut-out area to accommodate the solid member so that, when the flip top is in the closed position, the flip top and the upper surface of the solid member form a first substantially continuous surface, and wherein the flip top includes two projections on opposed sides of the cut-out area, each projection being received in a corresponding indentation in the solid member to couple the flip top to the solid member so that it may be rotated between the closed position and an open position in which the plug is removed from the aperture.

2. A closure according to claim 1, wherein the indentations are substantially hemispherical.

3. A closure according to claim 1, wherein the projections are substantially hemispherical.

4. A closure according to claim 1, wherein the projections are biased inward toward the solid member so that, when the flip top is left in an intermediate position between the open and closed positions, the flip top is maintained in the intermediate position.

5. A closure according to claim 1, wherein, when the flip top is in the closed position, a side surface of the flip top extends around the periphery of the first planar member so that the side surface of the flip top, and an outer surface of the solid member and the depending skirt form a second substantially continuous surface.

6. A closure including an improved hinge wherein, when in an operative position, the closure selectively seals an opening in a container, the closure comprising:

a cap member selectively coupleable to the container to cover the opening in the container, wherein the cap member includes a first substantially planar member and a depending skirt wherein, when the closure is in an operative position, a first side of the first substantially planar member faces the interior of the container and a second side faces away from the container, wherein an aperture is formed through the first substantially planar member;

a solid member integrally formed with the cap member, wherein the solid member projects out of the first substantially planar member in a direction away from the second side, wherein the solid member includes an upper surface and two opposed side surfaces, each of the opposed side surfaces including a projection extending away from the respective side surface; and a flip top including a plug wherein, when the flip top is in a closed position, the plug seals the aperture formed in the first substantially planar member and the flip top covers substantially all of the second side of the first planar member and wherein the flip top includes a cut-out area to accommodate the solid member so that, when the flip top is in the closed position, the flip top and the upper surface of the solid member form a first substantially continuous surface, and wherein each of the opposed sides of the cut-out area includes an indentation sized to receive a corresponding projection from a respective side of the solid member, each indentation receiving a corresponding projection to couple the flip top to the solid member so that it may be rotated between the closed position and an open position in which the plug is removed from the aperture.

7. A closure according to claim 6, wherein the indentations are substantially hemispherical.

8. A closure according to claim 6, wherein the projections are substantially hemispherical.

9. A closure according to claim 6, wherein the projections are biased inward toward the solid member so that, when the flip top is left in an intermediate position between the open and closed positions, the flip top is maintained in the intermediate position.

10. A closure according to claim 6, wherein, when the flip top is in the closed position, a side surface of the flip top extends around the periphery of the first planar member so that the side surface of the flip top, and an outer surface of the solid member and the depending skirt form a second substantially continuous surface.

* * * * *

UNITED STATES PATENT AND TRADEMARK OFFICE

CERTIFICATE OF CORRECTION

PATENT NO. : 5,417,350
DATED : May 23, 1995
INVENTOR(S) : James Y.C. Koo

It is certified that error appears in the above-indentified patent and that said Letters Patent is hereby corrected as shown below:

IN THE TITLE PAGE: At [22] Filed: Change "1984" to --1994--.

| Column | Line | Corrections |
|---|---|---|
| 6 | 1 | Change "effects" to --affects--. |
| 7 | 15 | Change "on to" to --onto--. |
| 8 | 4 | After "58'" insert --(the latter not visible in this view)--. |

Signed and Sealed this

Fourteenth Day of November, 1995

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,417,350

DATED : May 23, 1995

INVENTOR(S) : James Y.C. Koo

It is certified that error appears in the above-indentified patent and that said Letters Patent is hereby corrected as shown below:

IN THE DRAWINGS: Substitute Fig. 13 for the following corrected Fig. 13:

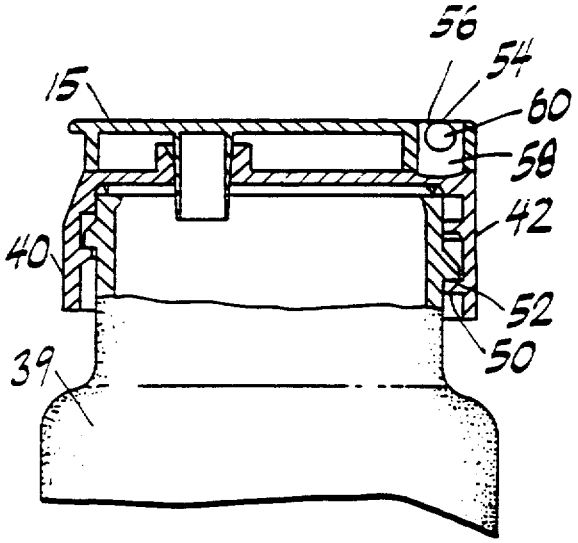

FIG. 13